US011143209B2

(12) United States Patent
Busani et al.

(10) Patent No.: US 11,143,209 B2
(45) Date of Patent: Oct. 12, 2021

(54) HYDRAULIC CIRCUIT HAVING A COMBINED COMPENSATION AND ENERGY RECOVERY FUNCTION

(71) Applicant: WALVOIL S.P.A., Reggio Emilia (IT)

(72) Inventors: Ulderico Busani, Reggio Emilia (IT); Davide Mesturini, Reggio Emilia (IT); Mattia Scolari, Reggio Emilia (IT)

(73) Assignee: WALVOIL S.P.A., Reggio Emilia (IT)

( * ) Notice: Subject to any disclaimer, the term of this patent is extended or adjusted under 35 U.S.C. 154(b) by 0 days.

(21) Appl. No.: 17/097,487

(22) Filed: Nov. 13, 2020

(65) Prior Publication Data

US 2021/0140448 A1 May 13, 2021

(30) Foreign Application Priority Data

Nov. 13, 2019 (IT) ..... 102019000021126

(51) Int. Cl.
*F15B 1/027* (2006.01)
*E02F 9/22* (2006.01)
*F15B 1/02* (2006.01)

(52) U.S. Cl.
CPC ..... *F15B 1/027* (2013.01); *E02F 9/2217* (2013.01); *E02F 9/2225* (2013.01); *F15B 1/024* (2013.01);
(Continued)

(58) Field of Classification Search
CPC ..... F15B 1/027; F15B 21/14; F15B 11/042; F15B 11/044; F15B 2211/351; F15B 2211/353; F15B 2211/88
See application file for complete search history.

(56) References Cited

U.S. PATENT DOCUMENTS 4,020,867 A * 5/1977 Sumiyoshi ..... F15B 13/0417 137/596.13
4,617,854 A * 10/1986 Kropp ..... E02F 9/2225 60/422
(Continued)

FOREIGN PATENT DOCUMENTS

DE 3930553 A1 3/1991
EP 0362409 A1 4/1990
(Continued)

OTHER PUBLICATIONS

Italian Search Report dated Jul. 21, 2020 from counterpart Italian App No. 201900021126.

*Primary Examiner* — Thomas E Lazo
(74) *Attorney, Agent, or Firm* — Shuttleworth & Ingersoll PLC; Timothy Klima

(57) ABSTRACT

A hydraulic circuit having a function of compensation and energy recovery comprises a distribution module, a three-way compensated regulator device, a variable flow rate or pressure feeding assembly, an energy recovery device connected to the three-way compensated regulator device. The distribution module comprises a spool including an inlet recess and a drain recess configured so that the flow rate of fluid inlet to the utility is equal to or less than the one outlet therefrom, possibly net of a correction factor. There is also a respective first driving channel and a second driving channel configured so that a pressure taken upstream of the drain recess acts on a first side of the regulator device, and so that a pressure taken downstream of the drain recess in the first channel acts on a second side of the regulator device, and an additional force.

15 Claims, 5 Drawing Sheets

(52) U.S. Cl.
CPC ... *F15B 2211/351* (2013.01); *F15B 2211/353* (2013.01)

(56) References Cited

U.S. PATENT DOCUMENTS 5,083,430 A * 1/1992 Hirata ..... F15B 11/163
60/445
5,146,747 A * 9/1992 Sugiyama ..... E02F 9/2232
60/452
5,289,679 A * 3/1994 Yasuda ..... E02F 9/2232
60/422

FOREIGN PATENT DOCUMENTS

IT 201700042145 A1 4/2017
JP 2007113755 A 5/2007

* cited by examiner

HYDRAULIC CIRCUIT HAVING A COMBINED COMPENSATION AND ENERGY RECOVERY FUNCTION

This application claims priority to Italian Patent Application 102019000021126 filed Nov. 13, 2019, the entirety of which is incorporated by reference herein.

TECHNICAL FIELD OF THE INVENTION

The invention falls within the field of hydraulic valve devices for managing hydraulic actuators by using pressure compensation devices.

TECHNOLOGICAL BACKGROUND

A known problem in off-highway applications, such as the ones of excavators, is the one of energy loss due to the work of compensators. An excessive choking of the in/out meter area due to the intervention of the local compensators results in an energy dissipation that is discharged through the fluid in the form of heat. For this reason, it is advantageous to reuse the energy which would be dissipated through the local compensator by channelling—if the compensator itself allows it—the primary flow into a bypass branch. According to the type of movement of the compensator, the bypass branch redirects the fluid being fed by making the regenerative connection and/or recharging a collector or other energy recovery devices in the presence of driving loads.

A possible solution to such problem is offered for said applications by using electrically-controlled proportional regulators in the place of the traditional compensation devices. Said regulators require high performance electronics and control system so as to allow the system to have quick reactions to the external disturbances and keep control over the regulating operations themselves. In addition, it is always necessary in said control system to assess the conditions of the main actuator by monitoring pressures and stroke of the actuator and of the regulators in real time. For this reason, implementing a system of this kind is complex and costly.

A further example of hydraulic circuit comprising a collector for energy recovery is proposed in Patent Application DE 39 30 553.

Such document describes a hydraulic circuit comprising a compensator arranged on the drain branch of a control valve for a single-effect actuation.

An outlet branch from the compensator is connected to the collector, to which a flow rate of fluid is sent under given operative conditions.

Further examples of hydraulic circuits are disclosed in IT 2017 0004 2145, JP 2007 113755 and EP 362 409.

SUMMARY OF THE INVENTION

The technical problem at the basis of the present invention is to make available a hydraulic circuit that is structurally and functionally conceived to overcome at least partially one or more of the limitations disclosed above with reference to the mentioned known technique.

Within the scope of such technical problem, the object of the present invention is to make available, a hydraulic circuit provided with three-way compensator capable of combining, with the usual flow regulating functions that are typical of compensators, the ability to manage a primary flow with the aim of saving energy with a simple, rational and affordable solution.

A further object is to make available a hydraulic circuit that allows at least partly recovering the energy that is normally dissipated in the case of driving loads or more generally, of inertial loads acting in the same direction as the movement.

It is also an object of the invention to make available a hydraulic circuit which, in the case of multiple utilities, allows achieving an energy recovery capability through the local compensation of the utilities having the lowest load.

It is another object again of the invention to make available a hydraulic circuit which, in case of multiple utilities, allows achieving a behaviour similar to the one of a load sensing flow sharing circuit, thus simultaneously achieving an energy recovery capability.

One or more of such objects are at least partially achieved by an hydraulic circuit comprising one or more of the features mentioned in the appended claims. The dependent claims outline preferred and/or particularly advantageous aspects of the invention.

The invention relates to a hydraulic circuit that comprises a hydraulic distribution module to one or more working sections, and comprising at least one compensated regulator device capable of managing a primary flow aiming to save energy.

Each of the working sections is formed by a spool intended to actuate a respective double-acting utility. According to an aspect of the invention, the spool is configured so that there is a simultaneous passage of fluid through the inlet recess and the drain recess of the spool.

It will be appreciated that within the present disclosure the term "utility" or "consumer" defines any hydraulic device that can be connected to a hydraulic distributor in order to provide a specific function or to transform hydraulic power into movement of components. Example of utilities are represented by hydraulic actuators, hydraulic cylinders or hydraulic motors.

It will be also appreciated that within the present disclosure the term "recess" means a notch formed on the spool defining a restricted passage through which fluid passes according to the position of the spool.

In preferred embodiments, the regulator device is connected to the spool outlet drain and may selectively convey the fluid to drain and/or to an energy recovery device.

In certain embodiments, the compensated regulator device is a three-way, three-position proportional valve. The control of said valve is performed by different pressure or load "signals" via specific channels.

According to another aspect of the invention, in a first position, the fluid is simultaneously sent to drain and provided to the energy recovery device; in a second position, the fluid is transmitted to the energy recovery device, preferably passing through a respective narrowed passage, and in a third position, there is no passage of fluid. Alternatively, all the passages may be choked to ensure the pressure required for all the operative conditions.

The control of the regulator device preferably occurs by causing a pressure taken upstream of the spool drain recess to act on a first side, and a pressure taken of the first channel of the regulator device, i.e. the one connected to the spool drain, to act on a second side, opposite to the first one, together with an additional force.

In certain embodiments, the additional force may be defined by the action of a spring, or of an equivalent element, that acts on the second side.

Based on a further aspect of the invention, the additional force may be defined by a hydraulic control acting on one of the sides of the regulator device.

In certain embodiments, the additional force is defined by a pair of hydraulic controls acting on the opposite sides of the regulator device.

On a general level, it should be noted that the use of a hydraulic control system in the present invention significantly simplifies the layout of the system and of the valve device in which it is inserted, and reduces the risks of the loss of control of the load should it be drifting rather than resistive, thus minimizing the risks for the operators.

An applied advantage in the movement of a double-acting hydraulic cylinder typically, but not exclusively, in the operations of removing the cylinder by redirecting the outlet flow rate of the recovery branch to the feeding branch of the cylinder, possibly through a check valve, is obtaining a compensated and speed-regulated flow regeneration that allows absorbing less flow rate from the circuit pump and accordingly, less power from the primary motor.

Another advantage in the movement of cylinders in the presence of driving loads by redirecting the outlet flow rate from the recovery line, possibly through a check valve, is the filling of a collector or the feeding of other energy recovery devices in order to store potential hydraulic energy to be reutilized in active working steps. It will be appreciated that driving loads refer preferably to external loads acting in the same direction of the movement of the actuator or more in general of the utility.

The present invention may also relate to a hydraulic circuit configured so as to feed a plurality of utilities. The actuation of the utilities may take place by providing also one spool alone connected, at the drain thereof, to a regulator device configured as described above, combined with other traditional working sections. The use in any case may be provided of several working sections with respective spools and regulator devices configured according to the present invention, combined with one or more traditional working sections, and also the exclusive use of sections obtained according to the present invention.

In general, in the case of several utilities, the control of the regulator device may be provided by a third control channel, through which the pressure provided by the feeding assembly, i.e. the inlet pressure, acts on the first side of the regulator device, and by a fourth channel through which a pressure signal taken from the utility having the highest pressure among all those fed by the feeding assembly, whether they are relative to sections obtained according to the present invention, traditional or otherwise obtained.

This characteristic in fact allows obtaining a circuit with load sensing flow sharing characteristics while taking advantage of the present invention.

It indeed is possible to provide a load sensing type of architecture by taking advantage of the utility of the pressure signal taken from the utility having the highest pressure, which in fact corresponds to the pressure LS.

According to another aspect again, the invention also relates to a circuit that comprises a plurality of spools for actuating respective actuators. A respective regulator device is associated with each spool.

Each regulator device is of the three-way, three-position type and is connected, at a first channel, to the drain of the respective spool with which it is associated, at a second channel, to drain, and at a third channel, to the energy recovery device, which preferably is common to all the regulator devices.

The control preferably is performed similarly to what is described above in reference to other embodiments of the invention.

Advantageously, in addition to allowing the energy recovery due to the inertial loads as described above, the hydraulic circuit of the present invention also allows recovering the energy dissipated through the local regulator devices themselves in the simultaneous movements on the utilities having the lowest load.

More generally, it can therefore be noted that the circuit of the present invention may allow an effective energy recovery also in applications with simultaneous utilities, thus correctly sharing the flow rates.

Said objects and advantages are all achieved by the hydraulic circuit the object of the present invention, which is characterized by the provisions of the claims below.

BRIEF DESCRIPTION OF THE DRAWINGS

This and other characteristics will be more apparent from the following description of certain embodiments illustrated by way of mere non-limiting example in the accompanying drawings, in which.

DETAILED DESCRIPTION OF THE INVENTION

Figure 1:
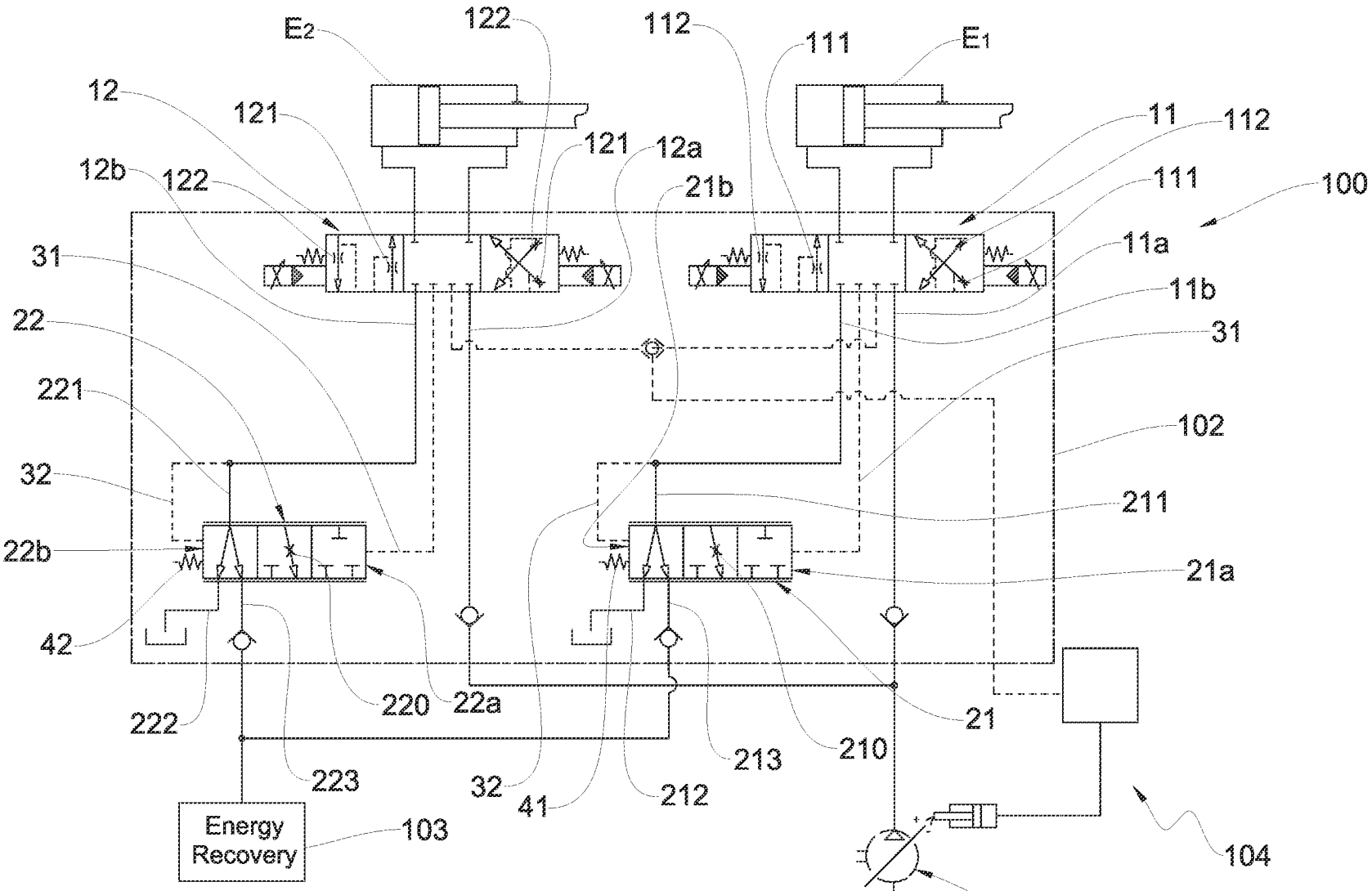
FIG. 1 is a schematic drawing of a hydraulic circuit having a function of compensation and energy recovery according to the present invention.

With initial reference to FIG. 1, a hydraulic circuit according to the present invention is shown as a whole with numeral 100.

As is noted below, the hydraulic circuit 100 of the present invention has the function of compensation and energy recovery.

The hydraulic circuit 100 is preferably fed by a variable flow rate or pressure feeding assembly 101 associated with a regulator 104 configured so as to regulate the flow rate provided by the feeding assembly 101.

In some embodiments, the feeding assembly 101 and the relative regulator 104 may be formed by a variable cylinder pump that regulates the flow rate based on the pressure $P_{LS}$ of the utility having the highest pressure among those fed by the feeding assembly.

The hydraulic circuit 100 comprises a distribution module 102 that receives a flow rate of operative fluid from the feeding assembly 101 to distribute the fluid towards one or more double-acting utilities E1, E2. It is to be noted that although there are two utilities in the embodiment shown in FIG. 1, the present invention may also be applied to the case of a single utility, or of a generic number of utilities n.

The distribution module comprises spools 11, 12 for actuating a respective utility, each of which defines an inlet channel 11*a*, 12*a* that receives a flow rate of fluid from the feeding assembly 101, and a drain channel 11*b*, 12*b* through which the fluid outlet from the actuator of the utility travels.

The distribution module 102 also comprises respective three-way compensated regulator devices 21, 22, the characteristics of which are illustrated in detail later.

Based on that illustrated above, alternatively to the embodiment described in FIG. 1, the circuit of the present invention may have one spool 11 alone and one regulator device 21 alone.

As a consequence, one spool 11 alone and a respective regulator device 21 are described below, it being understood that the same concepts may also be applied to the other spools and regulator devices possibly in the circuit.

Figure 2:
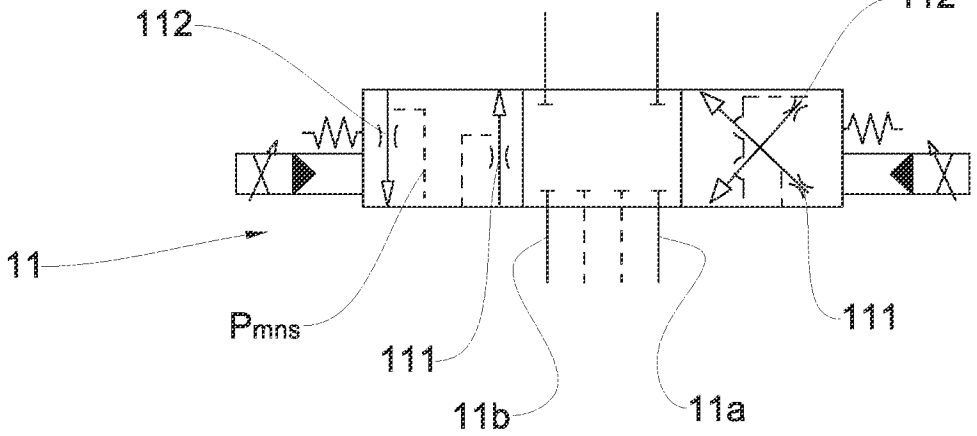
FIG. 2 is a schematic drawing of a spool of the hydraulic circuit of the present invention.

With reference also to FIG. 2, the spool 11 comprises an inlet recess 111 and a drain recess 112 associated with the respective inlet and drain channels.

The inlet recess 111 and the drain recess 112 are configured so that the flow rate of fluid inlet into the utility E1 is equal to or less than the one outlet therefrom, possibly net of a correction factor ε associated with the dimensional ratio between the differential areas of the hydraulic actuator. Such correction factor c may also be equal to 1 in case the areas of the actuator have the same surface.

As mentioned above, the utility E1 is of the double-acting type and as a consequence, the spool 11 is configured and connected to the utility E1 so that there is simultaneous passage of fluid through both the inlet recess 111 and the drain recess 112.

With reference again to the example shown in FIG. 1, the drain channel 11*b* of the spool 11 is connected to the regulator device 21 that therefore receives the flow rate outlet from the actuator, passing through the drain recess 112.

Figure 3:
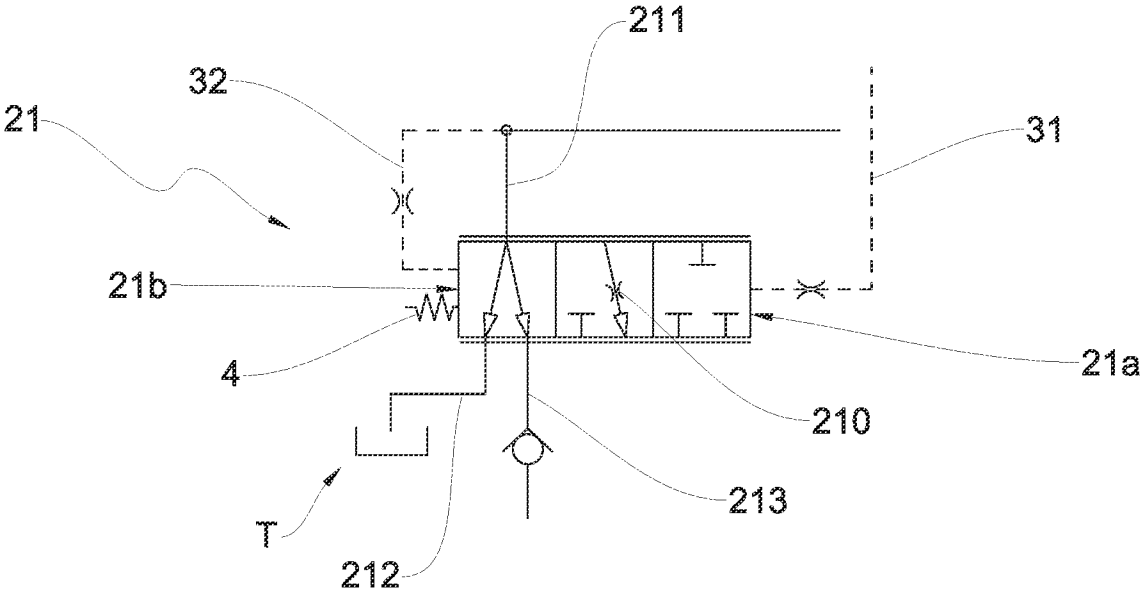
FIG. 3 is a schematic drawing of a regulator device of the hydraulic circuit the object of the invention.

An embodiment of the regulator device 21 is illustrated in detail in FIG. 3.

In particular, the three-way compensated regulator device 21 is connected to three channels: a first channel 211 is connected to the drain channel 11*b* of the respective spool 11, a second channel 212 is connected to a drain T and a third channel 213 is connected to an energy recovery device 103, the latter being illustrated in greater detail below.

The regulator device 21 preferably provides three regulating positions obtained by specific control signals.

According to a preferred embodiment, the control signals are provided by a respective first driving channel 31, through which a pressure $p_{mns}$ taken upstream of the drain recess 112 acts on a first side 21*a* of the regulator device, and by a second driving channel 32, through which a pressure taken of the first channel 211 of the regulator device 21 acts on a second side 21*b*.

In addition to the pressure taken of the first channel 211, an additional force also acts on the second side 21*b* which, in some embodiment, may be defined by the action of a spring or of an equivalent elastic element 4. It can in any case be noted that the additional force may also be provided by a hydraulic control acting on one of the sides of the regulator device.

In other words, the first driving channel 31 is taken in, i.e. connected at, a position downstream of the actuator of the utility E1 and upstream of the distribution module 102, and the second driving channel 32 is taken, i.e. connected at, in a position upstream of the three-way compensated regulator device 21 and downstream of the respective spool 11.

Preferably, in a first position, said valve is normally kept open and the first channel 10 is connected with the energy recovery device 103 and the drain line 3. As the difference in pressure between the first driving channel 31 and the second driving channel 32 increases, the regulator device starts moving towards a second position. In such intermediate position, the connection with the drain T is prevented, but the one with the recovery device 103 is kept through the third channel 213. Preferably, such second position, the flow rate of fluid originating from the drain channel of the spool is directed to the energy recovery device 103, passing through a narrowed passage 210. In this manner, the connection between the third channel 213 and the recovery device 103 takes on the nature of primary passage gap.

In the third position, the valve completely closes all the passages or chokes them to the extent of ensuring the pressure required for all the operative conditions. In other words, the passage of fluid towards the second channel 212 and to the energy recovery device 103 is prevented in the third position, or by reduced the passage section towards said second channel so as to ensure the pressure required for all the operative conditions.

Again with reference to FIG. 3, in the movement of actuators in the presence of driving loads, for example under return conditions of the actuator with the external force in direction concordant with the displacement of the actuator, the flow rate outlet from the energy recovery line may be redirected, possibly through a check valve to the energy recovery device(s) 103 in order to store potential hydraulic energy to be used again in new active working steps.

More generally, the regulator device 21, 22 may be configured so as to intervene if the utility actuated by the spool is subjected to an inertial load that acts in the same direction as the displacement of the actuator.

According to an aspect of the invention, in order to obtain the energy recovery action required, the energy recovery device 103 may comprise at least one accumulator that allows storing the hydraulic fluid in the cases in which the working conditions of the circuit allow it.

According to a further aspect of the invention, the energy recovery device 103 may be configured so as to reintroduce potential hydraulic energy back into the distribution module 102 that feeds the working sections, in other words, thus providing the feeding line of the hydraulic module with hydraulic fluid, for example collected in the collector.

According again on another aspect, the energy recovery device 103 may be configured so as to transfer said hydraulic fluid to a system or device for transforming potential hydraulic energy provided by said hydraulic fluid into another form of energy. For example, the device for transforming potential hydraulic energy may be depicted by an alternator generator or a flywheel.

It in any case is understood that also other solutions suitable for energy recovery may be provided within the realm of the circuit of the present invention, and the above examples are to be intended as given merely by way of non-limiting example.

It can also be noted that the energy recovery by means of the present invention is made possible also due to a suitable sizing of the drain 112 and inlet 111 recesses of the spool 11 and of the additional force acting on the regulator device 21. In particular, in the embodiment described now, the latter sizing may be associated with the equivalent standby pressures of the spring 41 and of the regulator 104 of the feeding assembly 101. Based on an aspect of the invention, the inlet flow rate Q1 to the utility will be equal to or less than the one Q2 outlet therefrom, possibly net of a correction factor c associated with the dimensional ratio between areas of the hydraulic actuator of the utility itself.

Such conditions may be defined by the following relations:

$$Q1 \sim R1\sqrt{\Delta p_{\mathrm{STBpump}}},$$

or in the case of a loading sensing system:

$$Q1 \sim R1\sqrt{p - p_{\mathrm{Ls}}},$$

$$Q2\sim R2\sqrt{p_{\text{drainpre112}}-p_{\text{drainpost112}}}\rightarrow Q2\sim R2\sqrt{p_{\text{STBspringdrain}}}$$

Where Q1 is the inlet flow rate of the actuator, Q2 the outlet flow rate of the actuator, $\Delta P_{STBpump}$ is the difference in pressure associated with the pump standby, p is the pressure provided to the inlet channel 111 of the spool to the feeding assembly, $p_{LS}$ is the load sensing pressure corresponding to the one of the utility having the highest pressure, R1 and R2 are two constants representing the characteristics of the inlet recess 111 and the drain recess 112, $p_{drain\ pre112}$ (called $p_{mns}$ above) and $p_{drain\ post112}$ are the pressures respectively upstream and downstream of the drain recess 112, and $\Delta P_{STB\ spring\ drain}$ is the difference in pressure associated with the spring 4.

Whereby, in the case of inertial loads acting in the same movement direction and such as to generate greater speeds than those generated by the inlet flow rate Q1, the drain compensator intervenes by imposing a return spring standby through the recess 112, and therefore by imposing a given flow rate Q2 depending on the return recess itself. The regulator device 11 intervenes by choking the passage between the return recess 112 and the drain T and allowing part of the pressurized flow rate to be channelled through the third channel 213 into the energy recovery unit 103.

Figure 4:
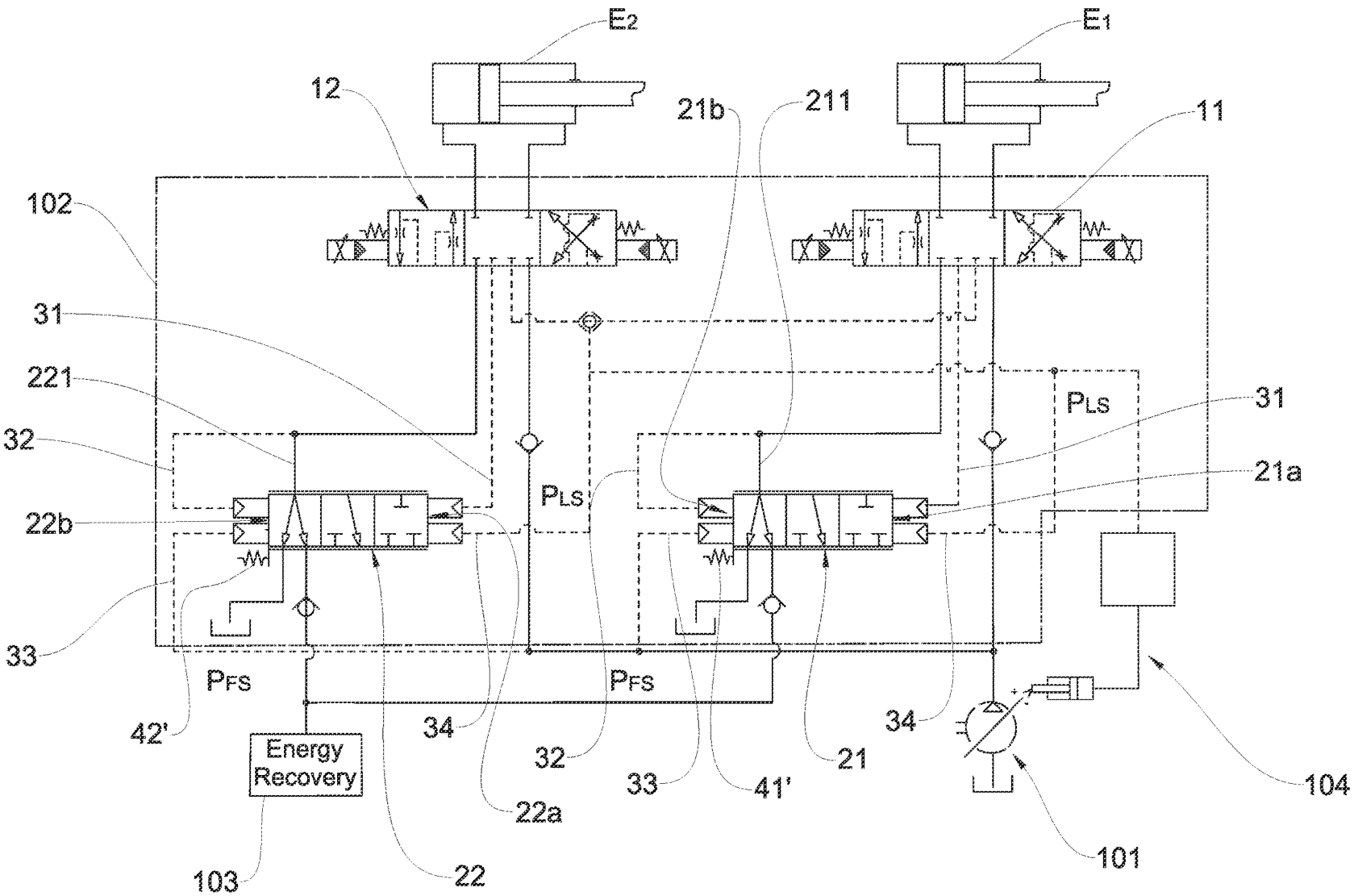
FIG. 4 is a schematic drawing of a hydraulic circuit having a combined function of flow sharing compensation and energy recovery according to an alternative embodiment of the present invention.
Figure 5:
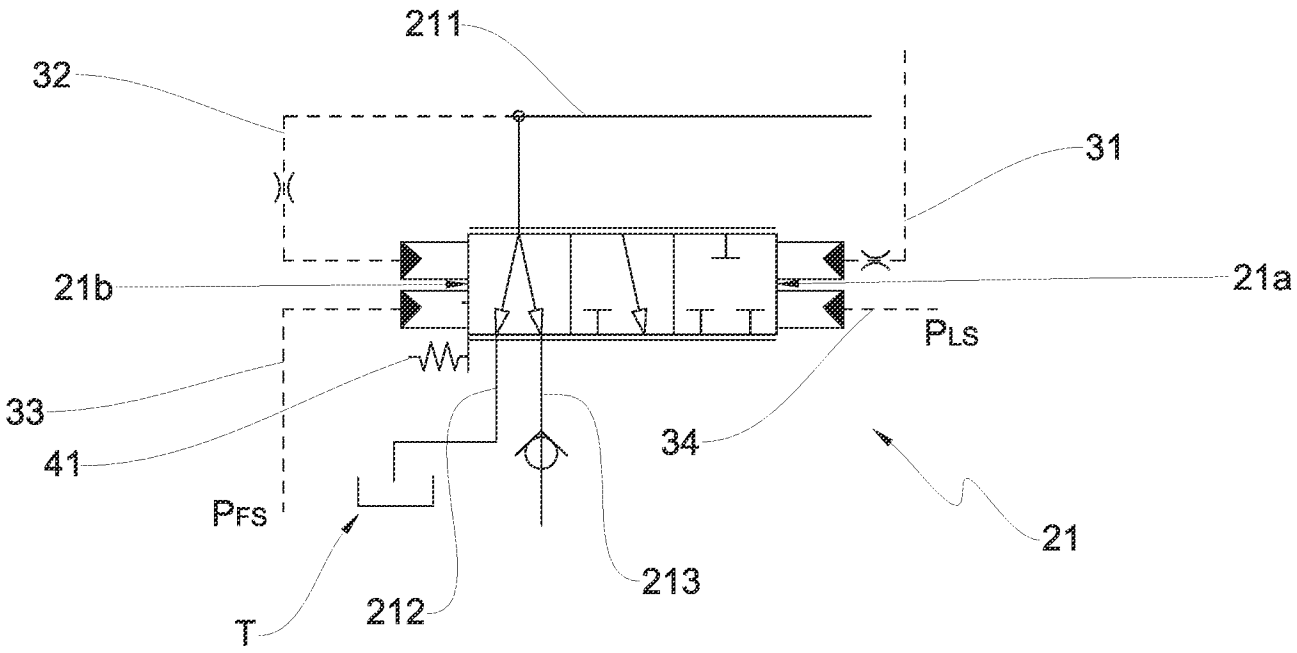
FIG. 5 is a schematic drawing of a regulator device of the hydraulic circuit in the embodiment of FIG. 4.

With reference now to the example of FIG. 4, an alternative embodiment of the present invention is described that allows implementing the compensated 3-way, 3-position regulator device 21 also in order to add a flow sharing functionality to the embodiment in FIG. 1, in addition to the one of performing energy recovery due to the inertial loads as mentioned above, and to recover the energy dissipated through the local regulator devices acting as local compensators in the simultaneous movements on the utilities having the lowest load.

In these embodiments, the hydraulic circuit 100 preferably comprises a third control channel 33, through which a pressure $P_{FS}$ provided by the feeding assembly 101 acts on the first side of the regulator device 21, 22, and a fourth channel 34, through which a pressure signal $p_{LS}$ taken from the utility E1, E2 having the highest pressure among all the utilities fed by the feeding assembly 101.

As illustrated above, hydraulic circuit may or may not be of the load sensing type and in the first case, the pressure signal $P_{LS}$ taken from the utility E1, E2 having the highest pressure signal preferably is sent to the regulator 104, thus obtaining the load sensing architecture.

It is also noted how the above-described control may also be used if the hydraulic circuit comprises one spool alone and respective regulator device made according to what is described above, combined with other utilities that are actuated in a different manner. Indeed, it is possible also in this case to obtain a pressure signal $P_{LS}$ taken from the utility having the highest pressure signal among all those fed by the feeding assembly.

It in any case is worth noting more generally that the action of the additional force may be defined by a pair of hydraulic controls acting on opposite sides of the regulator device 21, 22.

The operation of the hydraulic circuit in the case of the control of the regulator device 21 described above, is now illustrated.

The regulator device 21 combined with the energy recovery device 103 is preferably placed between the drain recess of the spool and the drain T.

As described above, the at the respective ends of the regulator devices act: the pressure taken upstream of the drain recess 112 of the spool on a first side, and the pressure taken between the drain recess and the regulator device 21 itself acts on a second opposite side. Rather than introducing a spring with equivalent pressure at the drain standby in this second side, like the example in FIG. 1, the signal $p_{LS}$ (here called $p_{FSLS}$) that corresponds to the pressure of the utility having the highest pressure is caused to act simultaneously on the first side and the inlet pressure p (here called $p_{FS}$) on the second side.

The regulator device 21 is therefore subjected to the stand-by thrust of the pump of the feeding assembly.

The signals acts two-by-two on areas A1 and A2, which are not necessarily equal to each other, based on the following relations:

$$p_{drain\ pre112}A1-p_{drain\ post112}A1=\Delta p_{STB\ spring\ drain}*A1\ p_{FS}*A2-p_{LSFS}*A2=\Delta p_{STBpump}*A2$$

A small centring spring 41', the elastic constant of which is much greater than $\Delta p_{STBpump}$, may also be inserted on the second side.

Practically, the regulator device 21 is subjected to the standby through the drain recess 112 in opposite direction to the feeding assembly standby.

Supposing a utility E2 is actuated and that the relative actuator requires 50 bar for the actuation, said pressure then becomes the signal $P_{LSFS}$ coming from the pump. Hypothesizing a pump standby of 20 bar, the pressure in $P_{FS}$ is 50+20=70 bar.

The drop in pressure through the inlet recess 111 to which an accurate flow rate Q1 corresponds is always 70−50=20 bar.

By then actuating a second utility E1 and assuming that the relative actuator requires an actuation pressure of 100 bar, the signal $p_{LSFS}$ becomes 100 bar and the inlet pressure $p_{FS}$=100+20=120 bar. The drop in pressure through the inlet recess 121 of the spool 22 would become 120−50=70 bar, to which corresponds an increase in the flow rate Q1 towards the actuator of the utility E2 with respect to the individual actuation. Proportionately, the return flow rate increases, and therefore the drop in pressure through the drain recess 122. Thus, the regulator device 22 intervenes, which forces a constant drop in pressure through the drain recess 122 equal to the pump standby to which it corresponds, with a suitable correspondence between the inlet and drain recesses, an inlet flow rate Q1 equal to the case of individual actuation, thus maintaining the same flow rate also in the simultaneous movements.

It is noted that from a functional viewpoint, the circuit of the present invention behaves like a traditional flow sharing distributor. Indeed, in the case of pump saturation, i.e. in the case in which the request of the various utilities actuated simultaneously exceeds the maximum flow rate of the pump. In this situation, the pump standby decreases. However, the local regulator devices 21 force the standby through the drain recess to be equal to the one of the pump. But then all the standbys of all the utilities decrease to the same value; accordingly all the flow rates of all the utilities decrease proportionately, similarly to the typical operation of a standard flow sharing system.

Finally, a further advantage of the present invention also arises in this embodiment in the case of inertial loads acting in the same direction as the movement and such as to generate greater speeds than those generated by the inlet flow rate.

In this situation, the regulator device at the drain intervenes by imposing the pump standby through the drain recess, and therefore by imposing a given flow rate Q2 depending on the return recess itself. The regulator device intervenes by choking the passage between the drain recess and the drain T and channelling part of the pressurized flow rate towards the energy recovery device, as described above.

The invention claimed is:

1. A hydraulic circuit having a function of compensation and energy recovery, comprising:

a distribution module for distributing hydraulic fluid, including a spool for actuating a double-acting utility, wherein:

the spool defines an inlet channel and a drain channel, a three-way compensated regulator device, wherein:

the regulator device comprises a first channel connected to the drain channel of the respective spool, the regulator device comprises a second channel connected to a drain;

a variable flow rate or pressure feeding assembly configured so as to provide a flow rate of operative fluid to the inlet channel to actuate a hydraulic actuator of the utility;

an energy recovery device connected to a third channel of the three-way compensated regulator device;

wherein said spool comprises an inlet recess and a drain recess, said inlet recess and said drain recess being configured so that the flow rate of fluid inlet to the utility is equal to or less than that outlet therefrom, possibly net of a correction factor associated with the dimensional ratio between differential areas of the hydraulic actuator of the utility, the spool being configured and connectable to the utility so that there is a simultaneous passage of fluid through the inlet recess and the drain recess; and wherein the hydraulic circuit further comprises a respective first driving channel and a second driving channel configured so that a pressure taken upstream of the drain recess acts on a first side of the regulator device, and so that a pressure taken downstream of the drain recess in the first channel of the regulator device acts on a second side of the regulator device, opposite the first side, and an additional force.

2. The hydraulic circuit according to claim 1, wherein said additional force is defined by action of a spring, or an equivalent elastic member, acting on said second side.

3. The hydraulic circuit according to claim 1, wherein said additional force is defined by a hydraulic control acting on one of the first and second sides of the regulator device.

4. The hydraulic circuit according to claim 3, wherein said additional force is defined by a pair of hydraulic controls acting on the opposite first and second sides of the regulator device.

5. The hydraulic circuit according to claim 4, wherein the feeding assembly is configured so as to provide the flow rate of fluid to a plurality of utilities, said hydraulic circuit further comprising a third control channel through which a pressure provided by the feeding assembly acts on the first side of the regulator device, and a fourth channel through which a pressure signal taken from the utility having a highest pressure among all the utilities fed by the feeding assembly.

6. The hydraulic circuit according to claim 1, further comprising a regulator configured so as to regulate the flow rate provided to the inlet channel by said feeding assembly.

7. The hydraulic circuit according to claim 6, wherein said pressure signal taken from the utility having a highest pressure is sent to said regulator with a load sensing type architecture.

8. The hydraulic circuit according to claim 1, wherein said distribution module comprises a plurality of spools for actuation of a respective utility, wherein each spool defines a respective inlet channel and a respective drain channel, a respective three-way compensated regulator device being connected to each spool through a respective first channel, wherein each regulator device further comprises a respective second channel and a respective third channel.

9. The hydraulic circuit according to claim 8, wherein the regulator devices are configured so that, in a case of simultaneous utilities, the flow rate provided by the feeding assembly is shared, channeling part of the pressurized flow rate towards said energy recovery device.

10. The hydraulic circuit according to claim 1, wherein said regulator device is configured so as to direct a flow rate of fluid provided through the drain channel of the spool to said energy recovery device through said third channel if the utility actuated by the spool is subjected to an inertial load acting in a same direction as a displacement of the hydraulic actuator.

11. The hydraulic circuit according to claim 1, wherein said regulator device is configured so that, in a first open position, the flow rate of fluid coming from the drain channel is simultaneously directed to drain through said second channel and to said energy recovery device, and in a second open position, the flow rate of fluid is directed only to said energy recovery device, passing through a narrowed passage, and in a third position, the passage of fluid towards said second channel and to said energy recovery device is prevented or the passage section is reduced by respective passages narrowed towards said second channel so as to ensure the required pressure for all the operative conditions.

12. A hydraulic circuit having a function of compensation and energy recovery, comprising:

a distribution module for distributing hydraulic fluid, including a plurality of spools for actuating a respective double-acting utility, wherein:

each spool defines an inlet channel and a drain channel, a plurality of three-way compensated regulator devices, each connected to a respective spool, wherein:

each regulator device comprises a respective first channel connected to the drain channel of the respective spool, each regulator device comprises a respective second channel connected to a drain;

a variable flow rate or pressure feeding assembly configured so as to provide a flow rate of operative fluid to the inlet channel to actuate a hydraulic actuator of the utility;

an energy recovery device connected to a respective third channel of the three-way compensated regulator devices;

wherein said spool comprises an inlet recess and a drain recess, said inlet recess and said drain recess being configured so that the flow rate of fluid inlet to the utility is equal to or less than that outlet therefrom, possibly net of a correction factor associated with the dimensional ratio between differential areas of the hydraulic actuator of the utility, the spool being configured and connectable to the utility so that there is a simultaneous passage of fluid through the inlet recess and the drain recess;

wherein the hydraulic circuit further comprises a respective first driving channel and a second driving channel configured so that a pressure taken upstream of the drain recess acts on a first side of the regulator device, and so that a pressure taken downstream of the drain recess in the first channel of the regulator device acts on a second side of the regulator device, opposite the first side, and an additional force.

13. The hydraulic circuit according to claim 12, wherein said additional force is defined by action of a spring, or an equivalent elastic member, acting on said second side.

14. The hydraulic circuit according to claim 12, wherein said additional force is defined by a hydraulic control acting on one of the first and second sides of the regulator device.

15. The hydraulic circuit according to claim 12, wherein said regulator device is configured so as to direct a flow rate of fluid provided through the drain channel of the spool to said energy recovery device through said third channel if the utility actuated by the spool is subjected to an inertial load acting in a same direction as a displacement of the hydraulic actuator.

* * * * *